United States Patent [19]

Steele et al.

[11] Patent Number: 4,714,046

[45] Date of Patent: Dec. 22, 1987

[54] ELECTROGRAPHIC MAGNETIC BRUSH DEVELOPMENT APPARATUS AND SYSTEM

[75] Inventors: Bruce B. Steele, Wyandotte, Mich.; Allen J. Rushing, Webster; Kelly S. Robinson, Rochester, both of N.Y.

[73] Assignee: Eastman Kodak Company, Rochester, N.Y.

[21] Appl. No.: 799,769

[22] Filed: Nov. 20, 1985

[51] Int. Cl.[4] ..... G03G 15/09

[52] U.S. Cl. ..... 118/657; 355/3 DD

[58] Field of Search ..... 118/657; 355/3 DD; 430/122

[56] References Cited

U.S. PATENT DOCUMENTS 4,473,029 9/1984 Fritz et al. ..... 430/122 X
4,614,420 9/1986 Lubinsky et al. ..... 118/657 X

FOREIGN PATENT DOCUMENTS 57-190974 11/1982 Japan ..... 355/3 DD
60-130774 7/1985 Japan .
60-130775 7/1985 Japan .
60-130776 7/1985 Japan .

*Primary Examiner*—Evan K. Lawrence

*Attorney, Agent, or Firm*—Warren W. Kurz

[57] ABSTRACT

A magnetic brush applicator for use in an electrographic reproduction apparatus for applying a magnetic developer to a recording element comprises a cylindrical non-magnetic sleeve having a rotatably driven magnetic core piece positioned therein. According to the invention, the axis of rotation of the magnetic core piece is displaced from the sleeve axis, such displacement being toward a development zone at which the applicator applies developer to the recording element. In a preferred embodiment, the rotational axis of the core piece lies in a plane passing through the sleeve axis, such plane being angularly displaced with respect to a second plane connecting the sleeve axis and the line of closest contact between the sleeve and recording element. Such angular displacement is between 0° and 20° in a direction upstream of the second plane as determined by the directioh of core piece rotation. As a result of the non-concentric arrangement between the applicator's sleeve and core piece, the torque requirements for rotating the core piece are reduced, developer replenishment is facilitated and less thermal energy is introduced into the developer during rotation of the core piece.

9 Claims, 4 Drawing Figures

ELECTROGRAPHIC MAGNETIC BRUSH DEVELOPMENT APPARATUS AND SYSTEM

BACKGROUND OF THE INVENTION

1. Field of the Invention

The present invention relates to the field of electrography and, more particularly, to improvements in magnetic brush apparatus and systems for developing electrostatic images.

2. Description of the Prior Art

In commonly assigned U.S. Pat. No. 4,473,029, there is disclosed an electrographic development system comprising a magnetic brush applicator and a two-component developer. The magnetic brush applicator comprises a cylindrical sleeve having concentrically positioned therein a cylindrically-shaped multi-pole magnetic core piece. Means are provided for rotating the magnetic core piece at a relatively high speed (e.g. 1000–3000 rpm) and, optionally, for rotating the sleeve at a slower speed (e.g. 50–100 rpm). The developer comprises a mixture of thermoplastic toner particles and "hard" magnetic carrier particles of high coercivity (>500 gauss) and induced magnetic moment (>5 EMU/gm in a field of 1000 gauss). The toner particles adhere to the carrier particles by triboelectric forces. During rotation of the magnetic core piece, the developer is transported along the sleeve's outer surface from reservoir to a development zone. There, the developer comes into contact with a latent electrostatic image, and toner is stripped from the carrier particles to effect image development. Following image development, the partially denuded carrier particles are stripped from the sleeve and returned to the development reservoir for toner replenishment.

In electrographic development systems of the type described in the above-noted patent, each of the developer's carrier particles is itself a tiny permanent magnet and behaves as such on the brush sleeve surface. Thus, as the magnetic core piece rotates at high speed within the sleeve, each carrier particle on the outer surface of the sleeve continuously flip-flops, end-for-end, in attempting to align itself with the rapidly changing magnetic field. While this fast-changing magnetic field and the resulting flipping action of the carrier results in excellent transport and mixing of the developer on the brush sleeve surface, it has the drawback of undesirably increasing the temperature of the developer mass. When the developer contains toner having a relatively low glass transition temperature, as is necessary in high speed copiers to effect rapid fusion of the toner to the copy sheet, toner agglomerations can form which have an adverse effect on toner replenishment and ultimately on image quality.

The developer heating problem noted above worsens as the time during which the developer is subjected to the high field gradient produced by the rotating core piece increases. Were it possible to feed the developer to the brush sleeve at a point just upstream of the development zone and to remove the developer from the brush immediately after development, the developer heating problems would be alleviated to a great extent. Unfortunately, due to many considerations, it is often impractical to supply developer to the brush sleeve at a location less than about 60° upstream of the development zone and to remove the developer any sooner than about 60° downstream of the developer zone. Unfortunately, during this 120° (or more) angular range that the developer is subjected to the high field gradient required to effect good development at the development zone, the developer heating problem arises.

Other technical problems associated with development systems of the rotating core/hard magnetic carrier type are those of high torque requirements and developer skiving difficulties. The torque requirements are high due to the need to rotate the core piece at high speed within the magnetic developer mass which, as indicated above, is in relatively close proximity to the core piece over an angular range of at least 120° of the core rotation. The magnetic field between the core piece and developer acts as a drag on the core piece, increasing the work required to rotate the core and, hence the power requirements of the overall copying apparatus. Skiving of the developer (e g. to effect toner replenishment) can be difficult because the developer must be physically stripped from the brush sleeve while in the presence of the same high magnetic field gradient required to effect good image development.

Since the severity of all of the above-noted problems is closely related to the magnetic field strength produced by the rotating core piece, an obvious solution might be to reduce the field strength of the core magnets. However, as copy throughput increases, one finds that this approach gives rise to another technical problem, namely, "carrier pickup," i.e., an undesired deposition of carrier particles in the developed image. Carrier pickup can produce devastating effects in the form of scoring of the recording element and other copier components (e.g. fusing and/or transfer rollers). To minimize carrier pickup, it is desirable to maintain a magnetic field at the development zone of at least 1000 gauss and, at this field strength, the aforementioned disadvantages return.

SUMMARY OF THE INVENTION

In view of the foregoing discussion, an object of this invention is to provide an electrographic magnetic brush development system of the type described which (a) has lower torque and power requirements, (b) introduces less thermal energy into the developer mix, (c) facilitates developer skiving for toner replenishment, and (d) is not susceptible to carrier pickup. This object is achieved by the provision of a magnetic brush applicator of unique geometry. In contrast with most prior art applicators in which the rotatably driven magnetic core piece is concentrically arranged within the non-magnetic cylindrical sleeve, the magnetic core of the brush applicator of the invention is non-concentrically arranged with respect to its surrounding sleeve; that is, the magnetic core axis is displaced from the sleeve axis. Further, according to the invention, the core axis is closer to the development zone than the sleeve axis. This geometry provides a strong magnetic field outside the sleeve only in the region where it is most critical, namely, in the vicinity of the development zone, and preferably in the region slightly downstream of such zone, i.e., in the direction of travel of the recording element. Everywhere else outside the sleeve, the field produced by the core is substantially reduced, allowing for easier skiving of developer, and lower torque requirements for rotating the core. Also, because the developer is subjected to a reduced magnetic field both upstream and downstream of the development zone, less thermal energy is introduced into the developer mass.

The invention and its various advantages will become more apparent to those skilled in the art from the ensuing detailed description of a preferred embodiment, reference being made to the accompanying drawings.

DETAILED DESCRIPTION OF PREFERRED EMBODIMENTS

Figure 1:
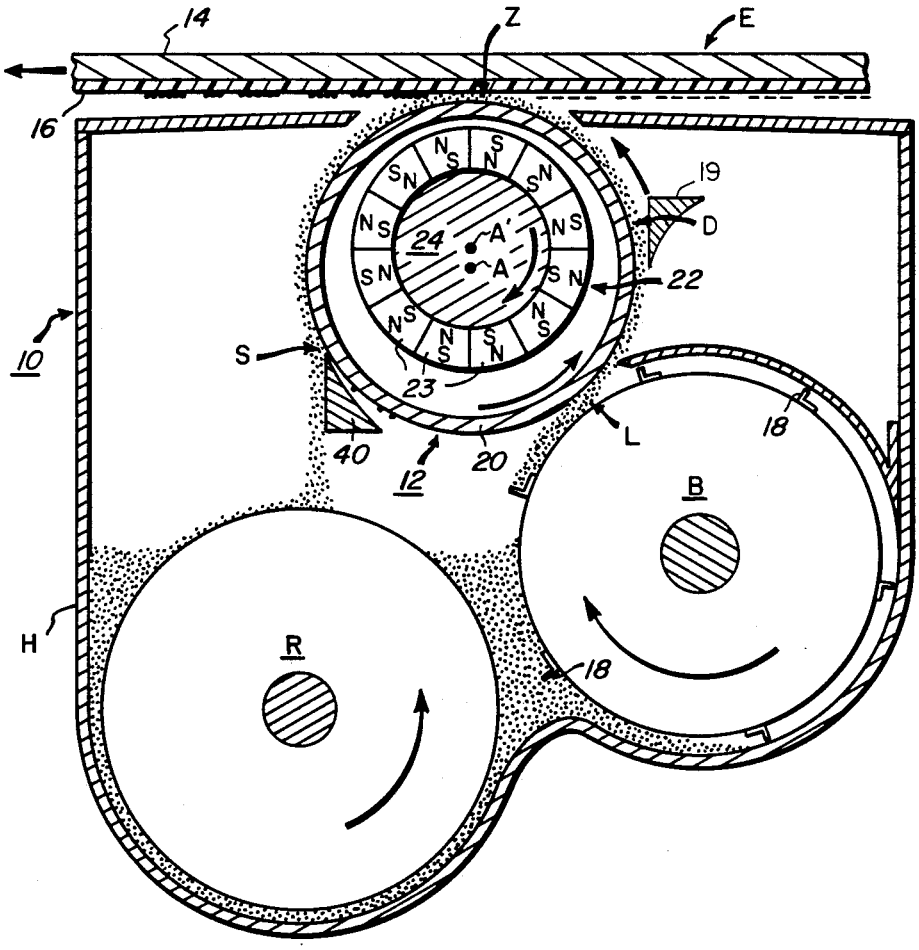
FIG. 1 is a cross-sectional illustration showing an electrographic development system embodying the invention.

FIG. 1 illustrates an electrographic development system 10 comprising a two-component developer D and a magnetic brush applicator 12 for applying such developer to the electrostatic image-bearing surface of an electrographic recording element E. The recording element may comprise, for example, a conductive substrate 14 having a photoconductive or dielectric layer 16 disposed thereon. The charge image borne by the recording element may be formed by any one of a variety of conventional electrographic or electrophotographic techniques. As the recording element is advanced in the direction of the arrow past the magnetic brush applicator 12, the charge image, indicated as a negative charge on layer 16, is presented to a development zone Z at which the upper surface of the magnetic brush applicator contacts the charge image and applies developer thereto.

The two-component developer D is contained by a sump housing H, and is supplied to the magnetic brush applicator by a bucket-brigade feeding mechanism B which rotates in the direction indicated by the arrow. As the bucket-brigade rotates, paddles 18 lift the developer from the sump and transports it to a loading zone L at which it is transferred to the brush applicator by magnetic forces, as explained below. A metering skive 19 controls the thickness of the layer of developer transported by the applicator to the development zone. After passing the development zone, the developer returns to the sump where it is mixed with fresh developer, such as by the ribbon blender R disclosed in the commonly-assigned U.S. application Ser. No. 597,323, filed Apr. 6, 1984.

Developer D is of the type best disclosed in the commonly-assigned U.S. application Ser. No. 440,146, filed Nov. 8, 1982 in the names of Miskinis and Jadwin, entitled "Two-Component, Dry Electrographic Developer Compositions Containing Hard Magnetic Carrier And Method For Using The Same". The developer comprises a mixture of pigmented, thermoplastic particles (commonly known as toner) and carrier particles to which the toner particles cling by triboelectric forces. Each of the carrier particles is itself a tiny magnet which exhibits a relatively square hysteresis loop. Preferably, such carrier particles exhibit a coercivity of at least 500 gauss when magnetically saturated, and an induced magnetic moment of at least 5 EMU/gm in the presence of an applied field of 1000 gauss. Such particles may be pre-magnetized prior to use or, alternatively, may become magnetized during use when subjected to the magnetic field produced by the magnetic brush applicator. It is important, however, in the practice of the invention that the developer be strongly attracted to the magnetic brush applicator so that the developer will be attracted to the applicator even in the presence of a magnetic field which is substantially weaker than that desired at the development zone for achieving good developer mixing and for preventing carrier pickup by the recording element.

The magnetic brush applicator 12 basically comprises a cylindrical sleeve 20 having a rotatably driven magnetic core piece 22 positioned therein. As shown, sleeve 20 has a circular cross-section and a central longitudinal axis A. The sleeve is made of a non-magnetic material, preferably stainless steel, aluminum or plastic. Magnetic core piece 22 is of conventional design comprising a plurality of elongated magnetic strips 23 positioned about the periphery of a cylindrical core 24 so that the respective exposed poles of such strips alternate around the core periphery (i.e., north-south-north-etc.). The core piece is rotatably driven in a clockwise direction, as viewed in FIG. 1, about its longitudinal axis A'. Movement of the core piece in a clockwise direction will cause movement of the developer in a counterclockwise direction, i.e., in a direction co-current with the direction of movement of the recording element (as shown by the arrow). Optionally, the cylindrical sleeve 20 may also be rotatably driven about its axis A. Preferably, the direction of rotation of sleeve 20 is countercurrent to that of the core piece, i.e., counterclockwise as viewed in FIG. 1.

As indicated above, the geometry of the magnetic brush applicator 12 is a key aspect of the present invention. Unlike conventional magnetic brush applicators of the rotating core variety, the applicator of the invention comprises means for rotating the magnetic core piece about an axis which is spaced from, but parallel to, the longitudinal axis A of the surrounding cylindrical sleeve. Owing to this non-concentricity between core and sleeve, and the fact that the core axis A' is displaced from axis A in a direction toward development zone Z, the magnetic field produced by the core piece is strongest in the development zone and gradually weakens in both the upstream and downstream directions from such zone along the circumference of the sleeve. The permissible displacement between axes A and A' depends on the magnetic characteristics of the core magnets and the carrier particles, the relative diameters of the core 22 and sleeve 20, the number of magnetic strips comprising the core piece, and the rate of rotation of the core piece. Functionally, the core piece/sleeve geometry should be such that the magnetic field strength at the development zone is sufficient to transport carrier particles through the development zone, as well as to minimize carrier pickup by the recording element during development. As indicated earlier, a field strength of approximately 1000 gauss is usually sufficient to meet these criteria for the magnetic particles disclosed in the aforementioned Miskinis et al application. Moreover, the field strength at the loading zone L at which developer is loaded onto the applicator sleeve by the bucket-brigade B must be sufficient to attract developer across the gap separating the sleeve and the bucket-brigade. Further, the magnetic attraction between the core piece and the developer should be sufficiently weak as to allow the partially denuded carrier particles to fall, under their own weight, from the sleeve surface following use, or, alternatively, be readily strippable from the sleeve by a skiving bar 40.

Figure 2:
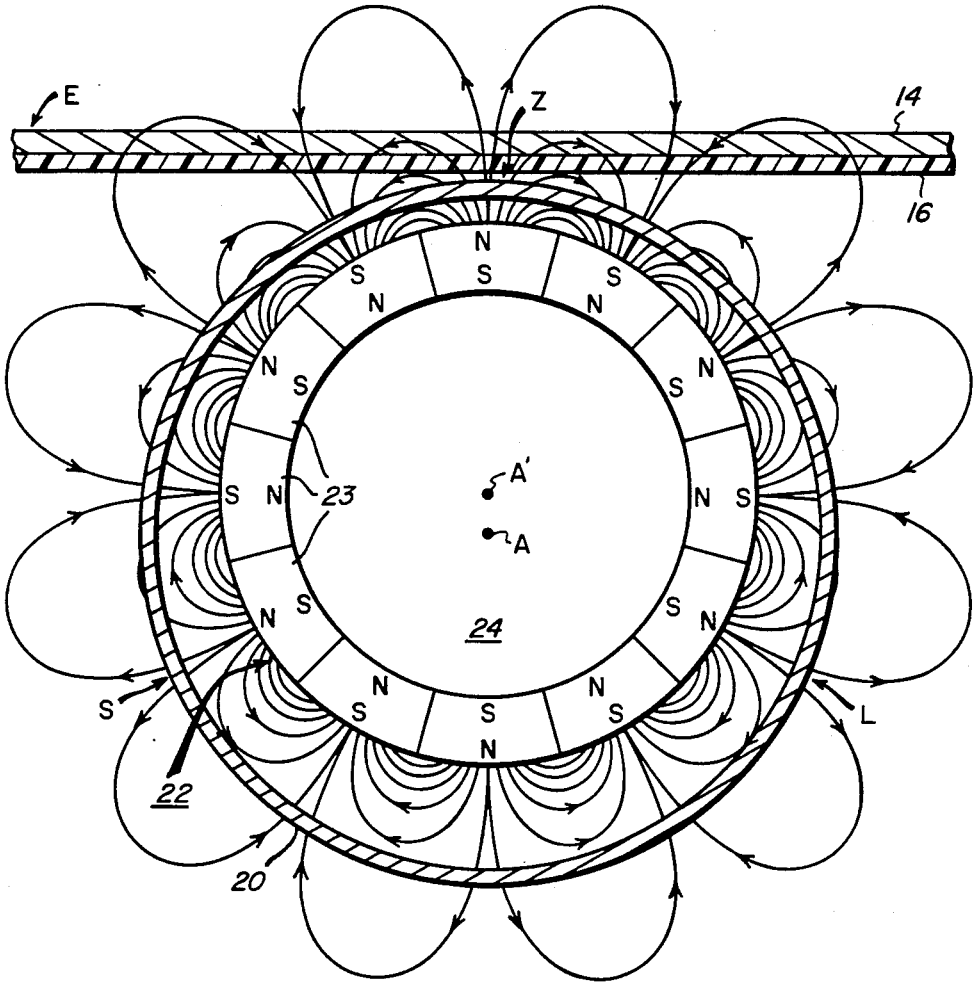
FIG. 2 is a magnetic field map of a magnetic brush applicator with a non-concentrically arranged magnetic core piece.

Referring to FIG. 2, the field map indicates the relative strength of the magnetic field around the periphery of sleeve 20. Owing to the non-concentric arrangement between core and sleeve, the magnetic field is significantly stronger in the development zone Z, as indicated by the number of flux lines penetrating the sleeve and entering the development zone. At the developer loading zone L, the magnetic field is relatively weak, but still sufficient to cause the developer to move from the bucket-brigade feeding mechanism to the outer surface of the applicator sleeve and adhere thereto. In the developer stripping zone S, the magnetic field is also significantly less than that at the development zone and, owing to the reduced field strength, the developer may be readily removed from the sleeve. In addition to reducing the amount of work required to remove the developer from the applicator sleeve after use, the non-concentric core/sleeve arrangement also affords the advantage of allowing the use of stronger magnets in the core piece. In concentric arrangements, the field strength of the core piece is often a tradeoff between a magnet which is sufficiently strong as to minimize carrier pick-up and to produce good transport and agitation of the developer, and a magnet which is sufficiently weak as to allow the developer to be stripped from the applicator sleeve for toner replenishment. In the applicator of the invention, the offset of the core axis A′ in a direction toward the development zone obviates the need for this trade-off.

Figure 3:
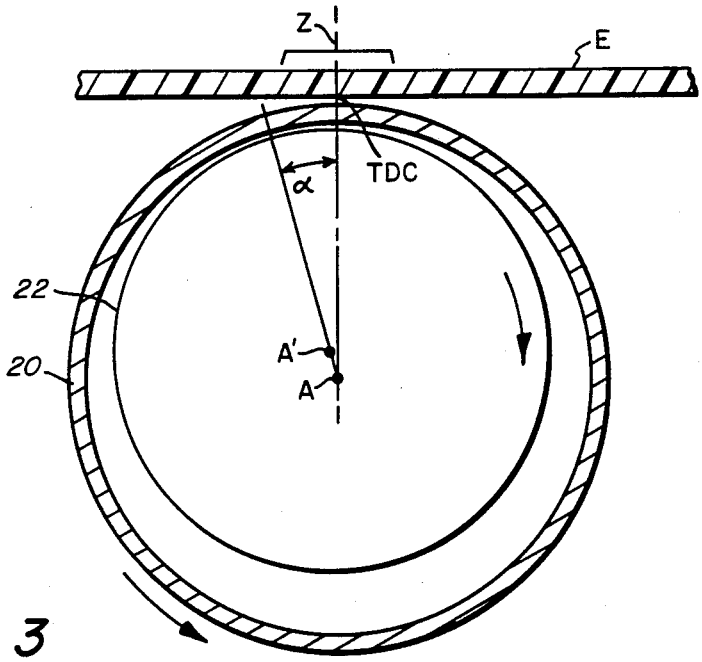
FIG. 3 illustrates a preferred core/sleeve geometry.

Referring now to FIG. 3, another preferred sleeve/-core configuration is shown in which the core axis A′ is displaced in a direction toward the development zone but rotated by a small angle $\alpha$ in a direction upstream from top-dead-center (TDC), i.e., the line of closest contact between sleeve 20 and the recording element, the "upstream" direction being determined by the direction of magnetic core rotation. A preferred range for angle $\alpha$ is from 0° and 20°. By this geometry, the field produced by the rotating core reduces the tendency for carrier to be picked up by the recording element during the development process.

Figure 4:
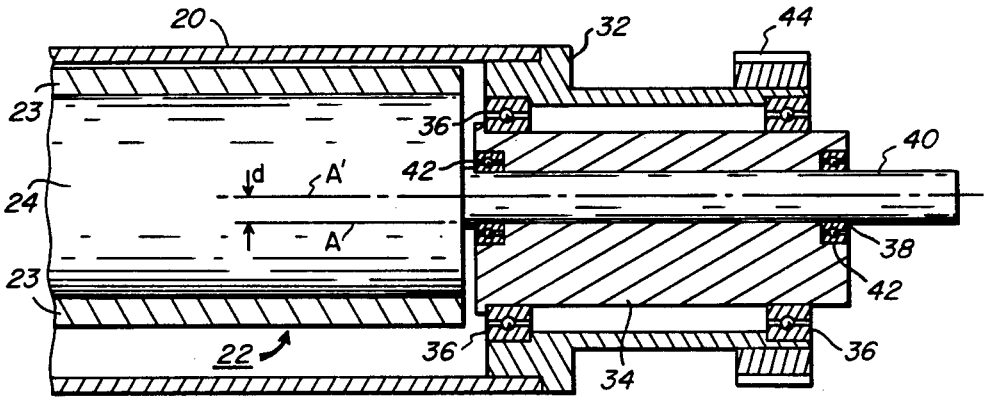
FIG. 4 is a cross-sectional illustration of apparatus for rotating the brush's outer sleeve and interior magnetic core about spacial parallel axis.

In FIG. 4, apparatus is shown for rotatably supporting sleeve 20 and magnetic core piece 22 for movement about the spaced, parallel axes A and A′, respectively. As shown, sleeve 20 is supported by a flanged end cap 32 which, in turn, is rotatably supported on a cylindrical member 34 by a pair of spaced bearings 36. The central longitudinal axis of member 34 coincides with the longitudinal axis A of sleeve 20. A bore 38 is formed in member 34 to receive the drive shaft 40 of core piece 22. The axis of bore 38 is displaced from axis A by a distance d, such distance corresponding to the desired displacement of axes A and A′. The non-concentrically positioned bore 38 is provided with a pair of bearings 42 for rotatably supporting the drive shaft 40 of core piece 22. Drive means (not shown) are provided for rotatably driving shaft 40 within bearing members 42, and, optionally, drive means may also be provided for driving sleeve 20 in the same or opposite direction about bearing members 36 via a pulley 44 or the like.

A test was conducted to compare the temperature rise of the non-concentric magnetic brush applicator described above with that of the conventional concentric design. Both applicators comprised fixed (i.e., non-rotating) stainless steel sleeves having identical rotatably driven core pieces therein. After 1 hour of operation with developer on the sleeve, the sleeve of the non-concentric applicator rose by only 5° F., while the sleeve of the conventional concentric applicator rose by 35° F. This test demonstrated that the non-concentric applicator runs substantially cooler than the conventional concentric design.

A second test was run to compare the torque required to drive the magnetic core of the applicator brush of the invention with that required to drive the core of the conventional concentric applicator. Each applicator had a fixed shell and identical magnetic core pieces driven at the same velocity. With no developer on the sleeves, the torques required to drive the cores were the same, about 18–36 gm/cm. When 20 grams of bare carrier were placed on the conventional concentric brush, the torque rose by a factor of about 7. When 20 grams of bare carrier were placed on the non-concentric applicator of the invention, the carrier fell from the brush at the apogee i.e., that point on the sleeve furthest displaced from the development zone, so that no torque measurement could be taken. To produce a meaningful reading, the non-concentric applicator was mounted in a developing station so that developer could be fed onto the brush continuously. The torque required to drive the magnetic core was approximately identical to that previously measured without developer. The result of these torque measurements illustrate that the non-concentric brush applicator of the invention reduces the torque required to drive the magnetic core by an order of magnitude.

While the invention has been described in detail with particular reference to preferred embodiments thereof, it will be understood that variations and modifications can be effected within the spirit and scope of the invention.

What is claimed is:

1. Magnetic brush apparatus for applying a magnetically attractive developer to a moving electrostatic image-bearing member at a development zone to effect developoment of such image, said apparatus comprising a cylindrical sleeve of non-magnetic material having a single magnetic core piece positioned therein, said core piece being rotatably driven and adapted to transport developer over a major portion of the sleeve surface, said core piece having a rotational axis which is displaced from the longitudinal axis of said cylindrical sleeve, said rotational axis lying in a first plane passing through the sleeve axis which is angularly displaced with respect to a second plane connecting the sleeve axis and the line of closest contact between said sleeve and said image-bearing member, said annular displacement being between 0° and 20° in a direction upstream of said second plane, as determined by the direction of rotation of said core piece.

2. The apparatus as defined by claim 1 wherein said sleeve is rotatably driven about its longitudinal axis.

3. The apparatus as defined by claim 2 wherein said sleeve rotation is in a direction opposite said core rotation.

4. An electrographic development system for developing an electrostatic image on a moving recording element at a development zone, said system comprising:

(a) a magnetic developer comprising particles having a coercivity of at least 500 gauss and an induced magnetic moment of at least 5 EMU/gram when subjected to an applied magnetic field of 1000 gauss; and (b) a magnetic brush applicator for applying said developer to said image at said development zone, said applicator comprising:

(i) cylindrical sleeve of non-magnetic material, said sleeve having a central longitudinal axis and being located such that a portion of its outer surface is closely spaced from the recording element at said development zone;

(ii) a single magnetic core piece positioned with in said sleeve, said core piece being rotatably driven about an axis which is displaced from and parallel to said sleeve axis, the rotational axis of said core piece being closer to said development zone than said sleeve axis, and lying in a first plane which passes through the sleeve axis and is angularly displaced relative to a second plane connecting said sleelve axis and the line of closest contact between said sleeve and the recording element, such angular displacement being between 0° and 20° in a direction upstream of said closest contact line, as determined by the direction of core piece rotation, said core piece functioning, when rotatably driven, to transport said developer over a major portion of the sleeve surface.

5. The system as defined by claim 4 further comprising means for rotating said sleeve about said longitudinal axis.

6. The system as defined by claim 5 wherein said sleeve rotation is in a direction opposite said core rotation.

7. In an electrographic apparatus comprising means for advancing an electrostatic image-bearing member along a path through a development zone, a magnetic brush apparatus for applying magnetically attractive developer to said member while it passes through said development zone to effect development of an electrostatic image thereat, said apparatus comprising:

(i) a cylindrical sleeve of non-magnetic material, said sleeve having a central longitudinal axis and being located such that a portion thereof is closely spaced from the image-bearing member at said developement zone; and (ii) a single magnetic core piece positioned within said sleeve, said core piece being rotatably driven at a speed of at least 1000 RPM about an axis which is displaced from and parallel to said sleeve axis, the rotational axis of said core piece being closer to said development zone than said sleeve axis, said rotational axis lying in a first plane which passes through said sleeve axis and is angularly displaced relative to a second plane connecting said sleeve axis and the line of closest contact between said sleeve and said image-bearing member, such angular displacement being between 0° and 20° in a direction downstream of said closest contact line, as determined by the direction of advancement of said image-bearing member, said core piece being adapted to transport developer over a major portion of the sleeve surface.

8. The apparatus as defined by claim 7 wherein said sleeve is rotatably driven about its longitudinal axis.

9. The apparatus as defined by claim 8 wherein said sleeve is rotated in a direction opposite that of said core piece.

* * * * *